United States Patent [19]

Gargas

[11] Patent Number: 5,022,827

[45] Date of Patent: Jun. 11, 1991

[54] PAINT SPRAYER APPARATUS INCLUDING RAPIDLY CHANGEABLE PRIME MOVERS

[75] Inventor: Eugene F. Gargas, Wellington, Ohio

[73] Assignee: The Wooster Brush Company, Wooster, Ohio

[21] Appl. No.: 930,258

[22] Filed: Nov. 13, 1986

[51] Int. Cl.[5] ..... F04B 39/14

[52] U.S. Cl. ..... 417/360; 417/362

[58] Field of Search ..... 417/234, 238, 374, 360, 417/361, 362; 418/70; 411/103, 107, 171, 393

[56] References Cited

U.S. PATENT DOCUMENTS

| | | | |
|---|---|---|---|
| 2,139,113 | 12/1938 | Cline et al. | 417/362 |
| 2,789,756 | 4/1957 | Allen | 417/362 |
| 2,812,895 | 11/1957 | Peeps | 417/234 |
| 2,927,537 | 3/1960 | Hunter | 418/70 |
| 3,199,745 | 8/1965 | Hollis et al. | 417/360 |
| 3,286,978 | 11/1966 | Lansky et al. | 411/393 |
| 3,320,895 | 5/1967 | Peterson et al. | 417/362 |
| 3,435,871 | 4/1969 | Johnson | 411/171 |

FOREIGN PATENT DOCUMENTS

| | | | |
|---|---|---|---|
| 600384 | 6/1960 | Canada | 417/362 |

*Primary Examiner*—Leonard E. Smith
*Assistant Examiner*—Eugene L. Szczecina, Jr.
*Attorney, Agent, or Firm*—Renner, Otto, Boisselle & Sklar

[57] ABSTRACT

Paint sprayer apparatus includes a paint sprayer frame having a sprayer apparatus mounted thereon, and two or more prime movers either of which may be interchangeably mounted on the frame for use in driving the sprayer pump. Each prime mover is provided with a pair of shoulder bolts in diagonally opposite corners of the respective prime mover bases that are adapted to be dropped into one or more pairs of correspondingly spaced slots in the paint sprayer frame. Fastener knobs threaded onto the outer ends of the shoulder bolts may be tightened or loosened and removed by hand to permit removal and replacement of one prime mover with another, and also loosened to permit proper adjustment of the belt tension. A belt tensioning stud may also be provided on the respective prime movers for receipt in an upwardly opening belt tensioning slot in the paint sprayer frame. An adjustable knob threaded onto the outer end of the stud may be tightened by hand when the fastener knobs are lossened to adjust the tension on the drive belt.

17 Claims, 3 Drawing Sheets

PAINT SPRAYER APPARATUS INCLUDING RAPIDLY CHANGEABLE PRIME MOVERS

BACKGROUND OF THE INVENTION

This invention relates generally as indicated to a paint sprayer apparatus including provision for rapidly changing the prime mover used to power the sprayer pump.

Gasoline engines are generally used to drive paint sprayers used for large painting jobs performed outside, or where electric power is not available, whereas electric motors are preferably used to drive paint sprayers for inside work, where electric power is available.

Heretofore, it was generally known to replace a gasoline engine used to drive a paint sprayer apparatus with an electric motor and vice versa. However, in the usual case, the time required to make the changeover was considerable, and tools were also required for that purpose. Accordingly, there is a need to be able to more rapidly change the prime mover from gas to electric and vice versa, preferably without the use of any tools and the like.

Also, from a manufacturing standpoint, there is a need to be able interchangeably to mount electric motors and/or gasoline engines of the same or different sizes made by the same or different manufacturers on the same paint sprayer frame to provide paint sprayers with the same or different output capacities. This is made especially difficult due to the fact that the motor mounts for different size motors made by the same manufacturer may be different. Also, the motor mounts for the same size motors made by different manufacturers may be different, which presents a mounting problem for the paint sprayer manufacturer especially if the paint sprayer manufacturer wants to interchangeably use motors from more than one motor source as is oftentimes the case.

It was previously known to provide a kit for paint sprayers to permit changeover of the prime mover from gas to electric and vice versa to suit a job or location. However, this involved attaching a bar both to the gasoline engine and electric motor for use in positioning the prime mover, and hanging the prime mover on the drive belt used to transfer power from the prime mover to the sprayer pump so that a portion of the weight of the prime mover provided the belt tension.

SUMMARY OF THE INVENTION

With the foregoing in mind, it is a principal object of this invention to provide a paint sprayer apparatus in which the prime mover is quickly and easily replaceable with another prime mover.

Another object is to provide such a paint sprayer apparatus in which the prime mover may rapidly be changed from a gasoline engine to an electric motor and vice versa.

In accordance with one aspect of the invention, both the gasoline engine and electric motor are provided with a pair of shoulder bolts that project downwardly beneath the respective engine and motor bases. The shoulder bolts are located in diagonally opposite corners of the respective prime mover bases and are adapted to be dropped into one or more pairs of correspondingly spaced slots in the paint sprayer frame. By staggering the bolts and bolt receiving slots and maintaining a close tolerance therebetween, precise alignment of the prime mover with respect to the paint sprayer pump is assured.

In accordance with another aspect of the invention, fastener knobs threaded onto the outer ends of the shoulder bolts may be tightened or loosened and removed by hand to permit removal and replacement of the prime mover and/or proper adjustment of the belt tension.

Further in accordance with the invention, the bolt receiving slots on the paint sprayer frame may be elongated in a direction generally parallel to the drive belt to permit limited movement of the prime mover along the slots for adjusting the tension in the drive belt.

Also in accordance with the invention, a belt tensioning stud may be provided on the respective engine and motor bases for receipt in a belt tensioning slot in the paint sprayer frame. The stud extends in a direction generally parallel to the drive belt and away therefrom. Threaded onto the outer end of the stud is an adjustable knob which may be tightened by hand when the fastener knobs are hand loosened to adjust the tension on the drive belt. When the proper belt tension has been reached, the two fastener knobs should be securely fastened by hand.

In accordance with another aspect of the invention, plural pairs of staggered slots may be provided in the paint sprayer frame, with different spacings therebetween corresponding to different spacings of the shoulder bolts which are attached to different prime movers manufactured by the same or different gasoline engine and/or electric motor manufacturers.

To the accomplishment of the foregoing and related ends, the invention, then, comprises the features hereinafter fully described and particularly pointed out in the claims, the following description and annexed drawings setting forth in detail certain illustrative embodiments of the invention, these being indicative, however, of but several of the various ways in which the principles of the invention may be employed.

DETAILED DESCRIPTION OF THE PREFERRED EMBODIMENTS

Figure 1:
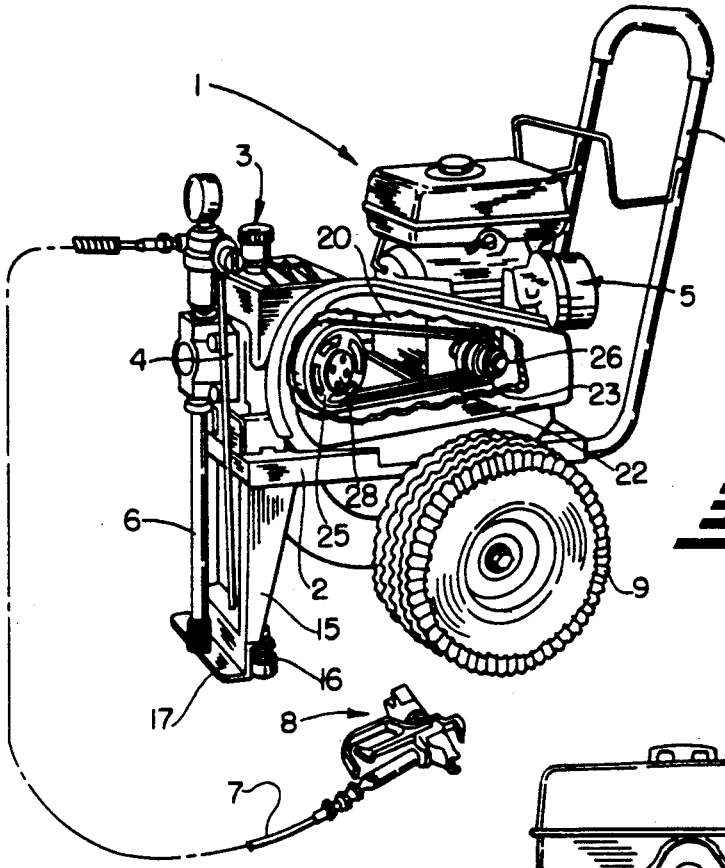
FIG. 1 is a perspective view of one form of paint sprayer apparatus in accordance with this invention including a gasoline engine as the prime mover.
Figure 2:
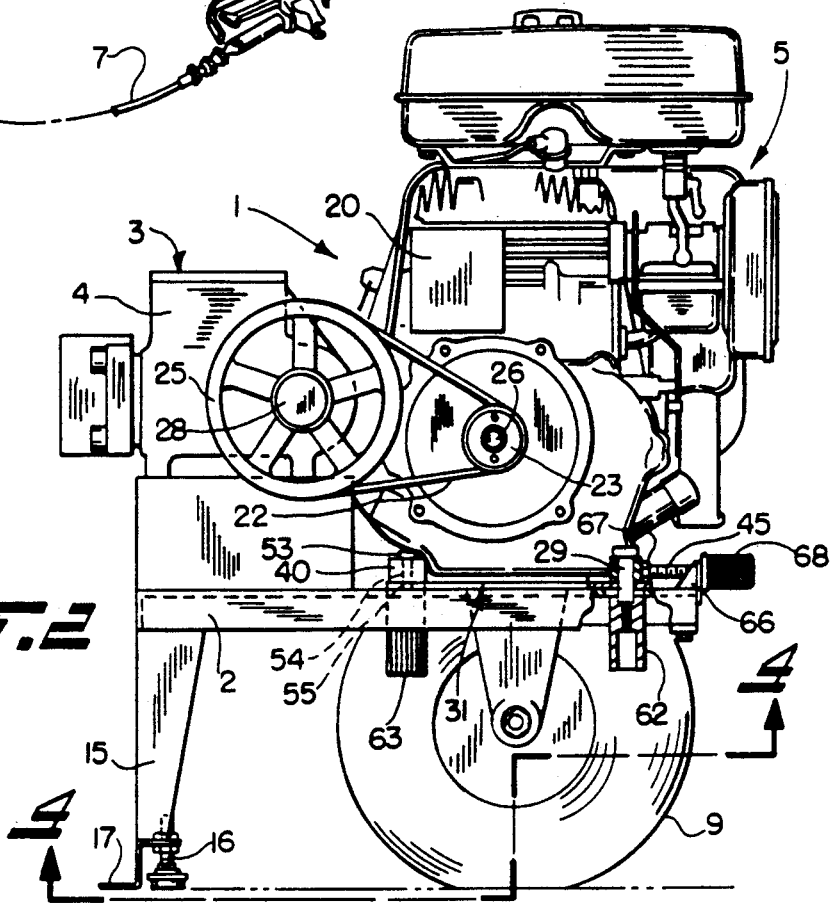
FIG. 2 is an enlarged partial side elevation view of the paint sprayer apparatus of FIG. 1, with portions of the prime mover mount broken away to show the manner in which the prime mover is removably attached to the paint sprayer frame.

Referring now in detail to the drawings, and initially to FIGS. 1 and 2 thereof, there is shown one form of paint sprayer apparatus 1 in accordance with this invention which may be used to spray many types of liquids including oil enamels, primers, sealers, stains, varnish, latex enamels, latex flat, oil-base paints, and acrylic latex. The paint sprayer apparatus 1 includes a paint sprayer frame 2 on which is mounted an airless paint sprayer 3 including a sprayer pump 4 which when driven by a suitable prime mover 5 as described hereafter, draws paint or other liquids up through a sump hose 6 into the pump and delivers same under pressure through a hose 7 to a paint spray gun 8 or the like.

The paint sprayer frame 2 may be mounted on wheels 9, with a handle 10 at one end of the frame for ease of movement of the paint sprayer apparatus from one location to another. Also, support legs 15 may be provided on the frame 2 in spaced relation to the wheels 9, with leg levelers 16 on the legs to permit leveling of the paint sprayer apparatus before use. An outturned flange 17 adjacent the bottom of the legs may be used as a holder for a paint bucket or the like (not shown) in alignment with the sump hose 6 for ease of insertion of the sump hose into the paint bucket.

Figure 5:
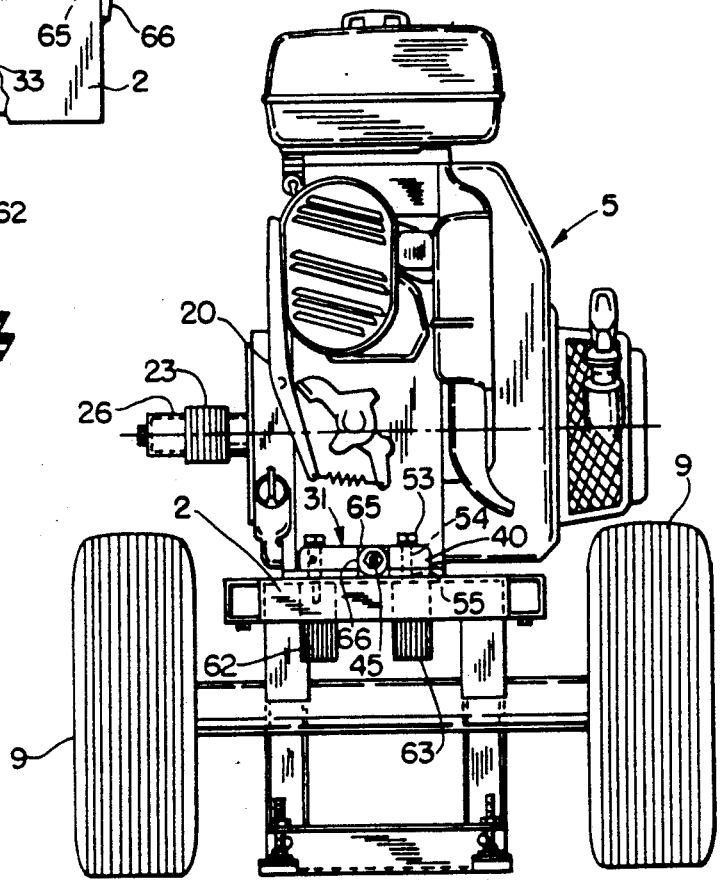
FIG. 5 is a partial end elevation view of the paint sprayer apparatus of FIG. 2 as seen from the right end thereof.

The prime mover 5 may either be a gasoline engine 20 (shown in FIGS. 1, 2 and 5) or an electric motor 21 (shown in FIG. 6), either of which may be mounted on the same paint sprayer frame 2 as described hereafter and drivingly connected to the same sprayer pump 4 by means of a drive belt 22 extending around pulleys 23, 24 and 25 on the respective prime mover output shafts 26, 27 and sprayer pump input shaft 28.

In accordance with one aspect of the present invention, the prime mover 5 which is used to drive the sprayer pump 4 may rapidly be changed from a gasoline engine 20 to an electric motor 21 or vice versa without the need for any tools and the like. This gives the user the versatility of being able to use a gasoline engine to drive the sprayer pump for outside work or where electric power is not available, and change to an electric motor for inside work where electric power is available.

Also, the same paint sprayer frame 2 may be adapted readily to accept the same or different size motors 21 and/or engines 20 made by the same or different manufacturers even though the engine or motor mounts may be different. This is particularly advantageous from the paint sprayer manufacturer's standpoint, since the manufacturer may wish to mount different size prime movers on the same size paint sprayer frame to provide different paint sprayer models having different output capacities. Also, this permits the paint sprayer manufacturer to interchangeably use motors/engines from more than one motor/engine manufacturer even though the motor/engine mounts may be different for the same size motor/engine, etc.

Figure 4:
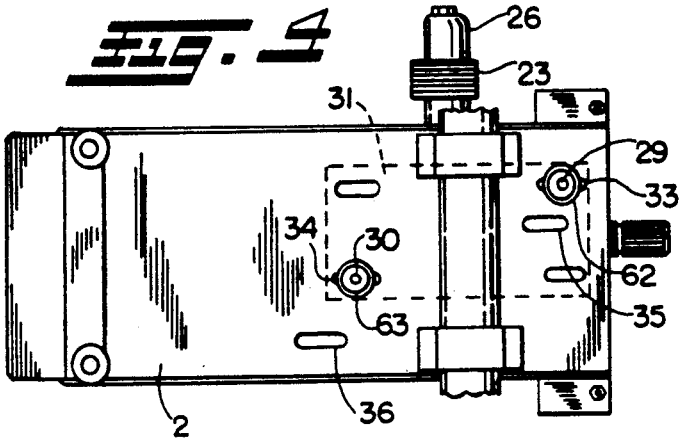
FIG. 4 is a partial bottom plan view of the paint sprayer frame of FIG. 2 as generally seen from the plane of the line 4—4 thereof.
Figure 7:
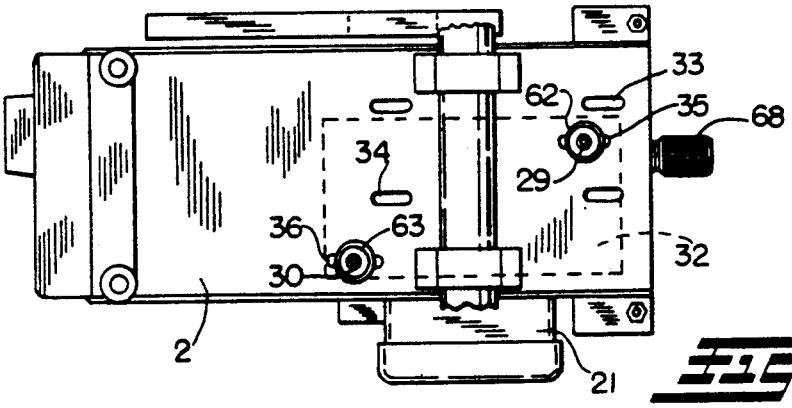
FIG. 7 is a partial bottom plan view of the paint sprayer apparatus of FIG. 6 as generally seen from the plane of the line 6—6 thereof.

As more fully described hereafter, such interchangeability of prime movers 5 is achieved in accordance with the present invention by providing each prime mover with two permanently attached shoulder bolts 29, 30 projecting downwardly beneath the respective engine and motor bases 31, 32 for receipt in two or more pairs of correspondingly spaced slots 33, 34 and 35, 36 in the paint sprayer frame. As schematically illustrated in FIGS. 4 and 7, the shoulder bolts 29, 30 are located in diagonally opposite corners of the respective prime mover bases 31, 32, and the slots 33, 34 and 35, 36 in the paint sprayer frame are correspondingly located. By staggering the shoulder bolts 29, 30 and respective bolt receiving slots 33, 34 and 35, 36 and maintaining a close tolerance therebetween, proper alignment of the respective drive pulleys 23, 24 on the gasoline engine 20 and electric motor 21 with the driven pulley 25 on the sprayer pump 4 for the drive belt 22 is maintained.

In the case of a gasoline engine 20 used as the prime mover, its base 31 is normally provided with a mounting flange 40 of sufficient thickness to properly maintain the orientation of the shoulder bolts 29, 30 within holes 41 therethrough, and also provide adequate support for attachment of a belt tensioning stud 45 thereto as described hereafter. In the case of an electric motor 21 used as the prime mover, on the other hand, a specially constructed mounting flange 46, shown in FIGS. 6 and 8, may be required to provide the necessary support for the shoulder bolts 29, 30 as well as the belt tightening stud 45.

Where there is a sufficiently thick mounting flange 40 on the prime mover, for example, where the mounting flange is approximately ¼ inch thick, a pair of holes 41 may be provided in the diagonally opposite corners of the mounting flange for close sliding receipt of the non-threaded shank portions 48 of the shoulder bolts 29, 30. One such hole 41 is clearly shown in FIG. 3. The other hole may be substantially identical but is located in the diagonally opposite corner of the engine base 31.

Figure 3:
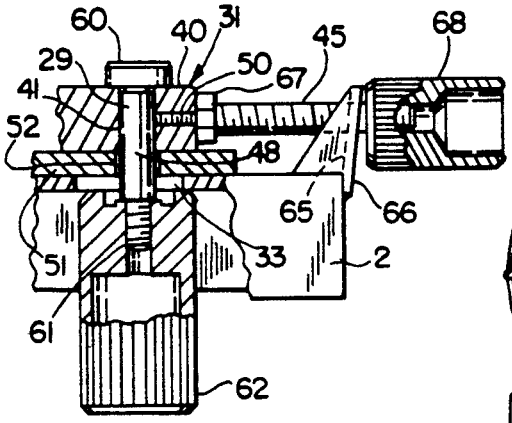
FIG. 3 is an enlarged fragmentary sectional view through one of the prime mover mounts for the gasoline engine of FIG. 2.

The shoulder bolts 29, 30 may also be provided with one or more flats thereon for engagement by respective set screws 50 extending through the wall of the flange 40 into engagement with the shoulder bolts as further shown in FIG. 3. Moreover, an engine mounting plate 51 having holes 52 therethrough for the shoulder bolts 29, 30 may be secured to the bottom of the motor mounting flange 40 as by means of screws 53 extending through holes 54 in the other diagonally opposite corners of the mounting flange and into threaded engagement with threaded holes 55 in the mounting plate (see FIGS. 2 and 5).

As noted previously, the paint sprayer frame 2 has a pair of appropriately spaced slots 33, 34 therein for receipt of the shoulder bolts 29, 30 projecting downwardly from the gasoline engine 20. By properly locating the slots 33, 34 within the paint sprayer frame 2 and maintaining a close tolerance between the slots and staggered shoulder bolts, precise alignment of the drive pulley 23 on the gasoline engine 20 with the driven pulley 25 on the sprayer pump 4 required for the drive belt 22 will result when the shoulder bolts are dropped into the slots. As best seen in FIG. 3, the shank portions 48 of the shoulder bolts 29, 30 are of sufficient length to pass through the motor flange 40 and engine mounting plate 51 as well as the paint sprayer frame 2. Although these dimensions may vary, in one form of the invention, the motor flange 40 may be approximately ¾ inch thick, the mounting plate 51 approximately ¼ inch thick, and the paint sprayer frame 2 approximately 3/16 inch thick, and the shank portions 48 of the shoulder bolts 29, 30 may be approximately 1¼ inch long.

At the ends of each shoulder bolt 29, 30 opposite the head 60 thereof is a threaded end portion 61 which extends downwardly below the paint sprayer frame 2 when the shoulder bolts are dropped into the respective slots 33, 34 as aforesaid for threaded engagement by fastening knobs 62, 63. When the fastening knobs are securely tightened by hand, such knobs will tightly press up against the underside of the paint sprayer frame as schematically shown in FIGS. 2 and 3 to securely hold the gasoline engine in place.

Before the fastening knobs 62, 63 are fully tightened, the drive belt 22 should be looped over the respective pulleys 23, 25 on the prime mover and sprayer pump so that the tension in the belt can be properly adjusted. To that end, the bolt receiving slots 33, 34 in the paint sprayer frame 2 are elongated in a direction generally parallel to the drive belt to permit limited movement of the prime mover along the slots for adjusting the tension in the belt. Also, the belt tensioning stud 45 is desirably provided on the prime mover as aforesaid. The belt tensioning stud extends outwardly from the motor flange 40 in a direction generally parallel to the drive belt 22 and away therefrom for receipt in a belt tensioning slot 65 in a bracket 66 on the paint sprayer frame 2. The upper end of the belt tensioning slot 65 is desirably open to facilitate dropping of the stud 45 into the slot 65 at the same time that the shoulder bolts 29, 30 are dropped into the respective slots 33, 34 in the paint sprayer frame. The belt tensioning stud 45 may be secured to the motor frame 2 in any suitable manner, for example, by providing a tapped plug 67 in one edge of the motor flange 40 for threaded receipt of the stud therein.

With the belt tensioning stud 45 received in the tensioning bracket slot 65, the tension in the belt 22 should be adjusted with the sprayer pump 4 running under full pressure and triggering the sprayer gun 8 intermittently while tightening a belt adjustment knob 68 on the outer end of the stud into pressing engagement with the outwardly facing side of the tensioning bracket 66 until belt slippage is eliminated. When the proper belt tension has been obtained, the prime mover 5 should be turned off the relieve pressure from the system before the two fastener knobs 62, 63 are securely tightened to securely retain the gasoline engine in the desired adjusted position.

Figure 6:
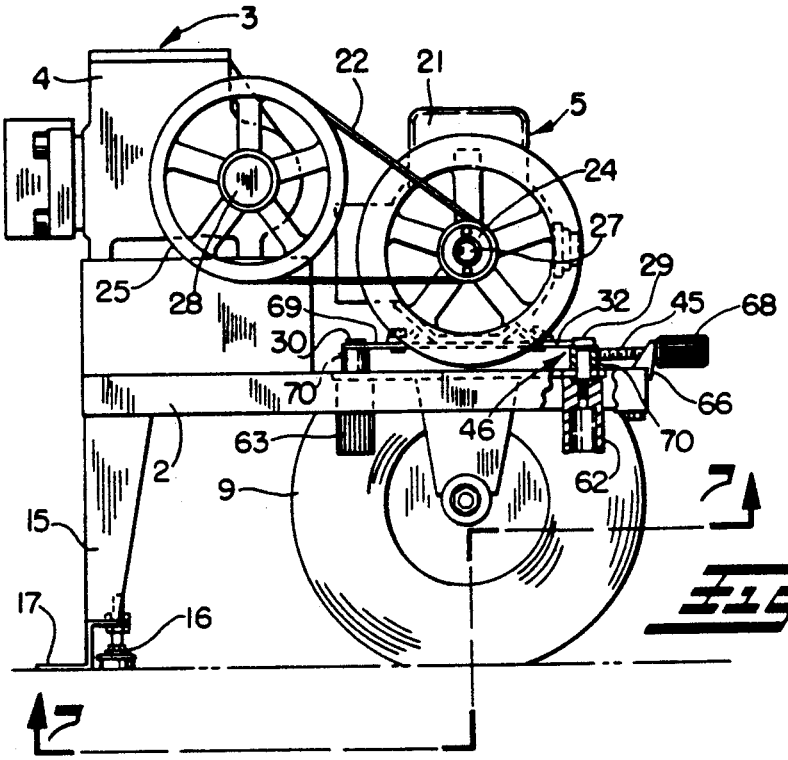
FIG. 6 is an enlarged partial side elevation view of a paint sprayer apparatus with portions broken away, similar to FIG. 2, but showing an electric motor substituted in place of the gasoline engine.
Figure 8:
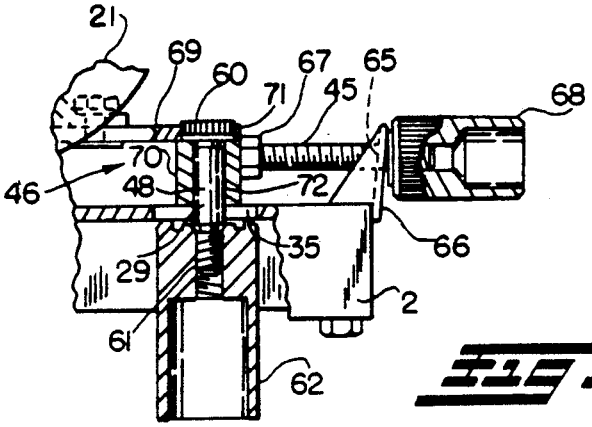
FIG. 8 is an enlarged fragmentary section through one of the motor mounts for the electric motor of FIG. 6.

When an electric motor 21 is used as the prime mover, it may not have a suitable mounting flange thereon to provide adequate support for the shoulder bolts 29, 30 and belt tensioning stud 45. In that event, a specially constructed mounting flange 46 may be provided for the motor including a mounting plate 69 having a pair of support bars 70 welded or otherwise secured to the bottom along opposite sides thereof as shown in FIGS. 6 and 8. The support bars 70 may, for example, be approximately 1 inch wide by 1 inch thick and extend substantially the full length of the plate 69, which may, for example, be approximately 6 inches wide, 10 inches long and ¼ inch thick.

The electric motor 21 itself may be bolted or otherwise secured to the top surface of the mounting plate 69 with the motor drive shaft 27 extending in a direction generally parallel to the support bars. At diagonally opposite corners of the mounting plate 69 are holes 71 in alignment with holes 72 in the support bars 70 for receipt of the shoulder bolts 29, 30. The holes 72 in the support bars 70 should have a close tolerance with the shank portions 48 of the shoulder bolts, similar to the holes 41 in the mounting flange 40 previously discussed. However, in this case, the holes 71 in the mounting plate 69 are desirably made somewhat larger so as to receive the heads 60 of the shoulder bolts 29, 30, which may be welded in place within the holes 71 in the mounting plate. The shank portions 48 should of course be of a length sufficient to pass through the support bars 70 and the slots in the paint sprayer frame 2, which may be the same slots 33, 34 that receive the shoulder bolts on the gasoline engine 20, or a different set of slots 35, 36, depending on whether the location and spacing of the shoulder bolts is the same. In either case, the threaded ends 61 of the shoulder bolts should extend downwardly beneath the paint sprayer frame 2 for threaded engagement by respective fastening knobs 62, 63 which, when securely tightened by hand, hold the electric motor 21 securely in place on the paint sprayer frame as before.

Likewise, a belt adjustment stud 45 may be attached to one of the support bars 70 similar to that previously described. That is, a tapped plug 67 may be provided in one of the support bars 70 for threaded receipt of one end of the belt adjustment stud 45. Otherwise, the particular mounting for the electric motor 21 shown in FIGS. 6–8 is substantially the same as that for the gasoline engine 20 shown in FIGS. 1–5.

From the foregoing, it will now be apparent that the prime mover mounts of the present invention provide for the facile interchangeability of the prime mover of a paint sprayer apparatus from a gasoline engine to an electric motor or vice versa. In actual tests, it has been found that the interchange of the prime movers can be done in accordance with the present invention in two minutes or less without the need for any tools, whereas it used to take approximately twelve minutes to make the changeover with the old system using tools to make the changeover.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the claims.

What is claimed is:

1. Sprayer apparatus comprising a frame, a sprayer pump mounted on said frame, and mounting means for interchangeably mounting any one of a plurality of prime movers on said frame, one at a time, for use in driving said sprayer pump, said one prime mover including a polygonally shaped base member having diagonally opposite corners, and said mounting means consisting of a single pair of shoulder bolts non-rotatably attached to said base member at said diagonally opposite corners, said shoulder bolts having non-threaded shank portions extending downwardly below said base member, and diagonally spaced slot means in said frame for close receipt of said non-threaded shank portions of said shoulder bolts, and threaded ends on the ends of said shank portions which extend below said frame when said shank portions are received in said slot means, and fastener knob means adapted to be threaded onto said threaded ends of said shoulder bolts and tightened against the underside of said frame by hand to secure said one prime mover in place on said frame and loosened and removed by hand to permit removal and replacement of said one prime mover.

2. The sprayer apparatus of claim 1 wherein there are a plurality of pairs of said diagonally spaced slot means in said frame having different spacings therebetween to accommodate different spacings between said single pair of shoulder bolts on different prime movers.

3. The sprayer apparatus of claim 1 wherein said sprayer pump and said one prime mover have shafts with pulleys thereon which are drivingly connected together by means of a drive belt extending therebetween, said slot means being elongated in a direction substantially parallel to said drive belt to permit limited movement of said one prime mover toward and away from said sprayer pump when mounted on said frame with said shoulder bolts extending through said slot means and said fastener knob means loosened to adjust the tension in said drive belt.

4. The sprayer apparatus of claim 3 further comprising bracket means on said frame remote from said sprayer pump, said bracket means having an upwardly opening belt tensioning slot therein, and a belt tensioning stud on said one prime mover adapted to be received in said belt tensioning slot when said one prime mover is mounted on said frame with said shank portions of said shoulder bolts extending through said slot means in said frame, and adjustable knob means threaded onto the outer end of said belt tensioning stud outwardly of said bracket means and engageable with said bracket means when tightened by hand while said fastener knob means are loosened to adjust the tension of said drive belt.

5. The sprayer apparatus of claim 1 wherein said one prime mover is a gasoline engine.

6. The sprayer apparatus of claim 5 wherein said base member for said gasoline engine includes a mounting flange, a mounting plate attached to the bottom of said mounting flange, and aligned holes in said mounting flange and mounting plate in diagonally opposite corners for receipt of said shoulder bolts, said holes in said mounting flange having a close tolerance with said non-threaded shank portions of said shoulder bolts.

7. The sprayer apparatus of claim 6 wherein said shank portions of said shoulder bolts are of a length to extend through said mounting flange and mounting plate and said slot means in said frame when said shoulder bolts on said prime mover are dropped into said slot means in said frame.

8. The sprayer apparatus of claim 6 further comprising set screw means extending through said mounting flange into engagement with said shoulder bolts for securing said shoulder bolts to said mounting flange.

9. The sprayer apparatus of claim 6 further comprising additional aligned holes in the other diagonally opposite corners of said mounting flange and mounting plate, and fastener means extending through said additional aligned holes for securing said mounting plate to said mounting flange.

10. The sprayer apparatus of claim 9 wherein said additional holes in said mounting plate are threaded, and said fastener means extend through said additional holes in said mounting flange and into threaded engagement with said additional holes in said mounting plate for securing said mounting plate to said mounting flange.

11. The sprayer apparatus of claim 6 wherein said sprayer pump and said gasoline engine have shafts with pulleys thereon which are drivingly connected together by means of a drive belt extending therebetween, and said slot means are elongated in a direction substantially parallel to said drive belt to permit limited movement of said gasoline engine toward and away from said sprayer pump when mounted on said frame with said shoulder bolts extending through said slot means and said fastener knob means loosened to adjust the tension in said drive belt.

12. The sprayer apparatus of claim 11 further comprising bracket means on said frame remote from said sprayer pump, said bracket means having an upwardly opening belt tensioning slot therein, and a belt tensioning stud on said mounting flange of said gasoline engine adapted to be received in said belt tensioning slot when said gasoline engine is mounted in said frame with said shoulder bolts extending through said slot means in said frame, and adjustable knob means threaded onto the outer end of said stud outwardly of said bracket means and engageable with said bracket means when tightened by hand while said fastener knob means are loosened to adjust the tension of said drive belt.

13. The sprayer apparatus of claim 1 wherein said one prime mover is an electric motor, and said base member for said electric motor includes a mounting plate attached to the bottom of said electric motor, a pair of support bars attached to the bottom of said mounting plate along opposite sides thereof, and aligned holes in said mounting plate and support bars in diagonally opposite corners of said mounting plate for receipt of said shoulder bolts, said holes in said support bars having a close tolerance with said non-threaded shank portions of said shoulder bolts.

14. The sprayer apparatus of claim 13 wherein said shoulder bolts have enlarged heads on the ends opposite said threaded ends, and said holes in said mounting plate are of a size to receive said heads of said shoulder bolts.

15. The sprayer apparatus of claim 14 wherein said heads of said shoulder bolts are welded in place in said holes in said mounting plates.

16. The sprayer apparatus of claim 13 wherein said sprayer pump and said electric motor have shafts with pulleys thereon which are drivingly connected together by means of a drive belt extending therebetween, and said slot means are elongated in a direction substantially parallel to said drive belt to permit limited movement of said electric motor toward and away from said sprayer pump when mounted on said frame with said shoulder bolts extending through said slot means and said fastener knob means loosened to adjust the tension in said drive belt.

17. The sprayer apparatus of claim 16 further comprising bracket means on said frame remote from said sprayer pump, said bracket means having an upwardly opening belt tensioning slot therein, and a belt tensioning stud on one of said support bars adapted to be received in said belt tensioning slot when said electric motor is mounted on said frame with said shoulder bolts extending through said slot means in said frame, and adjustable knob means threaded onto the outer end of said belt tensioning stud outwardly of said bracket means and engageable with said bracket means when tightened by hand while said fastener knob means are loosened to adjust the tension of said drive belt.

* * * * *